US006124068A

United States Patent [19]

Kobayashi et al.

[11] Patent Number: 6,124,068

[45] Date of Patent: Sep. 26, 2000

[54] CARRIER FOR ELECTROPHOTOGRAPHIC DEVELOPMENT AND ELECTROPHOTOGRAPHIC DEVELOPER CONTAINING THE SAME

[75] Inventors: Hiromichi Kobayashi; Yuji Sato; Toshio Honjo, all of Kashiwa, Japan

[73] Assignee: Powdertech Co., Ltd., Chiba-Ken, Japan

[21] Appl. No.: 09/220,378

[22] Filed: Dec. 24, 1998

[30] Foreign Application Priority Data

Dec. 26, 1997 [JP] Japan ..... 9-360879

[51] Int. Cl.[7] ..... G03G 9/113

[52] U.S. Cl. ..... 430/108; 430/110

[58] Field of Search ..... 430/108, 110

[56] References Cited

U.S. PATENT DOCUMENTS

| | | | |
|---|---|---|---|
| 4,600,677 | 7/1986 | Hoffend et al. | 430/108 |
| 5,068,301 | 11/1991 | Okamura et al. | 528/15 |
| 5,071,726 | 12/1991 | Maniar | 430/108 |

FOREIGN PATENT DOCUMENTS

| | | |
|---|---|---|
| 0 785 242 | 7/1997 | European Pat. Off. . |
| 56-126843 | 10/1981 | Japan . |
| 60-76754 | 5/1985 | Japan . |
| 61-024643 | 9/1986 | Japan . |
| 61-284775 | 12/1986 | Japan . |
| 4-204666 | 7/1992 | Japan . |
| 7-160054 | 6/1995 | Japan . |
| 7-160056 | 6/1995 | Japan . |
| 2 119 108 | 11/1983 | United Kingdom . |

*Primary Examiner*—John Goodrow
*Attorney, Agent, or Firm*—Young & Thompson

[57] ABSTRACT

A carrier for an electrophotographic developer comprising a carrier core coated with a silicone resin containing a quaternary ammonium salt as a catalyst.

11 Claims, No Drawings

CARRIER FOR ELECTROPHOTOGRAPHIC DEVELOPMENT AND ELECTROPHOTOGRAPHIC DEVELOPER CONTAINING THE SAME

BACKGROUND OF THE INVENTION

1. Field of the Invention

The present invention relates to a carrier for two-component electrophotographic developer used in copying machines and printers and to an electrophotographic developer containing the carrier.

2. Description of Related Art

A two-component developer used for developing an electrostatic latent image in electrophotography comprises a toner and a carrier. The carrier is mixed and agitated with the toner in a development box to give a desired charge quantity to the toner and carries the charged toner onto an electrostatic latent image formed on a photosensitive material (photoreceptor) to form a toner image.

The carrier remains on the magnet and is returned to the development box where it is again mixed and agitated with fresh toner particles for repeated use.

In order to maintain high image quality over a service life of a developer in a stable manner, the carrier is required to have stable characteristics over the life.

To meet the requirement, carriers comprising a core and a resin coat have been proposed. Because a developer is always under the stress of collisions among the particles or with the wall of a development box or a photoreceptor, etc. during the service life, the toner adheres to the surface of the carrier particles, that is, so-called spent phenomenon. Further, the resin coat comes off the core by the collisions, which results in variations of charging characteristics, resistivity characteristics and fluidity. As a result, it has been difficult to maintain the initial image quality in a stable manner.

Conventional coating resins, such as a styrene-acrylate copolymer, a styrene-butadiene copolymer, and a polyurethane resin, having a high surface tension, are liable to have toner particles adhere to increase the resistivity. This has been a cause of deterioration of image quality such as fog, i.e., background stains with a toner.

Fluorocarbon resins, while relatively effective in preventing toner adhesion, have low film strength and poor adhesion to the core and therefore tend to separate from the core, which results in reduction of resistivity, failing to maintain the initial image quality.

Silicone resins having a low surface tension have been proposed as a countermeasure against toner adhesion. However, silicone resins per se are apt to be worn, failing to keep electrical resistance, chargeability, fluidity, and the like over the long service life and to maintain the initial image quality.

In order to stabilize the charging characteristics of silicone resins, Japanese Patent Laid-Open Nos. 76754/85 and 284775/86 suggest addition of an organotin compound. The organotin compound accelerates curing of a silicone resin to form a very hard coating film, but the coating film is so brittle to impacts that it comes off considerably due to the stress in a development box to cause large variations in chargeability and resistivity, failing to maintain the initial image quality.

Japanese Patent Laid-Open Nos. 168056/83 and 204666/92 propose introduction of a quaternary ammonium salt into a resin skeleton for the purpose of chargeability maintenance. Although the techniques disclosed are effective in suppressing the change of chargeability with environmental changes, they did not succeed in improving the film strength, failing to maintain the initial image quality over a long service life, either.

Additionally, a resin-coated carrier generally has a high resistivity, which makes it difficult to obtain a sufficient image density and also leads to the liability to cause fogging. In order to overcome these problems as well as the problem that the resistivity is liable to change during a long service life, Japanese Patent Laid-Open No. 126843/81 teaches a method for controlling the initial electrical resistance and stabilizing the resistance characteristics during the service life, which comprises adding an electrically conducting agent to a coating resin.

However, acrylic resins or fluorocarbon resins even containing an electrically conducting agent still fail to maintain the initial image quality not only because of the above-mentioned disadvantage but also because they have poor capability of holding the conducting agent and easily release the conducting agent while use.

Further, Japanese Patent Laid-Open No. 204643/86 proposes addition of an electrically conducting agent to a silicone resin. However, an organotin compound or titanium compound, which is generally used as a curing catalyst for silicone resins, is so powerful that the curing rate is too high to allow the conducting agent to be sufficiently incorporated into a silicone resin before completion of curing. As a result, the resulting cured silicone resin cannot hold the conducting agent certainly, easily releasing the conducting agent under the stress in a development box to cause a drastic change in resistivity, which rather accelerates deterioration of the image characteristics.

SUMMARY OF THE INVENTION

Accordingly, an object of the present invention is to provide a carrier for an electrophotographic developer which is prevented from undergoing great changes in resistivity, chargeability and fluidity and is therefore capable of maintaining the initial image characteristics over a long service life and to provide an electrophotographic developer containing such a carrier.

As a result of extensive study, the inventors of the present invention have found that the above object is accomplished by the following invention.

That is, the present invention provides a carrier for an electrophotographic developer which comprises a carrier core coated with a silicone resin containing a quaternary ammonium salt as a catalyst.

The present invention also provides an electrophotographic developer comprising the above-described carrier and a toner.

Further, the present invention provides a carrier for electrophotographic development and electrophotographic developer containing the same which comprises a carrier core coated with a silicone resin containing a quaternary ammonium salt catalyst preferably in an amount of 0.5 to 5% by weight Furthermore, the present invention provides a carrier for electrophotographic development and electrophotographic developer which comprises a carrier core covered with a silicone resin containing a quaternary ammonium salt catalyst, whereby the initial image characteristics are maintained over a long service life, particularly when a conducting agent is used for adjusting the resistivity and. chargeability.

The carrier for an electrophotographic developer according to the present invention is characterized in that the curing and crosslinking of the silicone resin has proceeded gradually in the presence of a quaternary ammonium salt catalyst to form a coating film exhibiting improved strength and improved adhesion to the core. The carrier of the present invention undergoes little change in such physical properties as chargeability, resistivity, and fluidity over a long service life. The electrophotographic developer containing the carrier according to the present invention undergoes little change in image density and fog and is capable of maintaining the initial image characteristics over a long service life.

DETAILED DESCRIPTION OF THE INVENTION

In the present invention, a carrier core is coated with a silicone resin containing a quaternary ammonium salt as a catalyst, and the silicone resin which can be used in the present invention is not particularly limited and includes methylsilicone resins, methylphenylsilicone resins, and modified silicone resins such as acrylic-, epoxy-, urethane-, polyethylene- or alkyd-modified silicone resins.

The quaternary ammonium salt which can be used in the present invention as a curing catalyst is represented by formula:

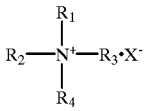

wherein $R_1$, $R_2$, $R_3$, and $R_4$ each represent a hydrogen atom, an alkyl group or a derivative thereof, or an allyl group or a derivative thereof; and X represents a sulfate ion, a nitrate ion, an organic sulfate ion, an organic nitrate ion, an organic carboxylate ion, etc.

In the above formula, $R_1$, $R_2$, $R_3$, and $R_4$ each preferably represents an alkyl group, particularly an alkyl group having 1 to 4 carbon atoms, and X preferably represents an organic carboxylate ion, particularly an organic carboxylate ion having 1 to 4 carbon atoms.

Examples of the quaternary ammonium salt include tetramethylammonium acetate, tetraethylammonium acetate, tetrapropylammonium acetate, tetrabutylammonium acetate, tetramethylammonium propanate.

The degree of crosslinking and curing of the silicone resin gradually increases during a coating step and a heating step in the presence of the quaternary ammonium salt to achieve improved adhesion to the core. Gradual progress of curing and crosslinking also results in formation of a coating film having sufficient strength. The adhesion to the core and the coating film strength can further be improved by properly controlling the content of the quaternary ammonium salt. A preferred quaternary ammonium salt content ranges from 0.2 to 10% by weight, particularly 0.5 to 5% by weight, based on the silicone resin. If the quaternary ammonium salt content is less than 0.2% by weight, the effect cannot be obtained sufficiently. If it exceeds 10% by weight, the catalytic activity is so strong that the coating film becomes brittle. In the case where an electrically conducting agent (hereinafter simply referred to as a conducting agent) is incorporated into the silicone resin, since the resin is capable of including the conducting agent with sufficient compatibility while gradually crosslinking and curing in the presence of the quaternary ammonium salt, the resulting cured resin exhibits improved capability of holding the conducting agent. In this case, too, the effect of the catalyst cannot be obtained sufficiently at a content less than 0.2% by weight. At a catalyst content more than 10% by weight, the curing proceeds too rapidly, resulting in a failure of securing sufficient holding properties for the conducting agent.

Any substance having electrical conductivity can be used as a conducting agent for adjusting the resistance and chargeability of the carrier, including conductive carbon, borides such as titanium boride, and oxides such as titanium oxide, iron oxide and chromium oxide. Conductive carbon is especially preferred. Known carbon black species, such as furnace black, acetylene black, and channel black, can be used as conductive carbon. The conducting agent is preferably used in an amount of 0.5 to 100 % by weight, particularly 1 to 50% by weight, especially 5 to 20% by weight, based on the silicone resin. If the conducting agent content is less than 0.5% by weight, sufficient conductivity cannot be obtained. If it is more than 100% by weight, the conducting agent cannot be supported by the resin sufficiently.

The carrier core material used in the present invention is not particularly limited and includes iron powder, ferrite powder, and magnetite powder. Ferrite powder comprising Cu, Zn, Mg, Mn, Ca, Li, Sr, Sn, Ni, Al, Ba, Co, etc. is preferred. The carrier core is not limited in shape, surface properties, particle size, magnetic characteristics, resistivity, chargeability, and the like.

The coating weight of the silicone resin on the core is preferably 0.05 to 10.0% by weight, still preferably 0.1 to 7.0% by weight, based on the core. The coating thickness should be adjusted according to the specific surface area of the core so as to minimize the exposed area of the core thereby to minimize changes of the developer in resistivity, chargeability and fluidity. A preferred thickness of the coating film is 0.02 to 2.0 $\mu$m.

Coating of the core with the silicone resin is usually carried out by a wet process comprising applying the silicone resin as diluted with a solvent onto the surface of the core. Any solvent capable of dissolving the silicone resin is employable. Suitable solvents include toluene, xylene, cellosolve butyl acetate, methyl ethyl ketone, methyl isobutyl ketone, and methanol. The resin diluted with the solvent is applied to the core by dip coating, spraying, brush coating, kneading or a like technique, and the solvent is then evaporated. In the present invention a fluidized bed coating apparatus is preferably used for securing uniformity of coating thickness. A dry process comprising coating the core with a powdered resin is also effective.

After coating, the coating layer can be baked, if desired, either by external heating or internal heating by means of, for example, a fixed bed or fluidized bed electric oven, a rotary kiln type electric oven, a burner oven, or a microwave oven. The baking temperature depends on the silicone resin and should be not lower than the melting point or glass transition point of the silicone resin used. In using a heat-curing or condensation-curing silicone resin, the baking temperature should be raised up to a point at which curing proceeds sufficiently.

The core thus coated with the silicone resin and baked is cooled, ground, and regulated in size to obtain a silicone resin-coated carrier.

The carrier according to the present invention is mixed with a toner to provide a two-component developer for electrophotography. The toner to be used comprises a binder resin having dispersed therein a charge control agent, a colorant, etc.

While not limiting, the binder resin which can be used in the toner includes polystyrene, chloropolystyrene, a styrene-chlorostyrene copolymer, a styrene-acrylate copolymer, a styrene-methacrylic acid copolymer, a rosin-modified maleic acid resin, an epoxy resin, a polyester resin, a polyethylene resin, a polypropylene resin, and a polyurethane resin. These binder resins can be used either individually or as a mixture thereof.

The charge control agent to be used in the toner is selected arbitrarily. Useful charge control agents for positively chargeable toners include nigrosine dyes and quaternary ammonium salts, and those for negatively chargeable toners include metallized monoazo dyes.

Any known dyes and pigments are useful as a colorant. Examples of suitable colorants are carbon black, Phthalocyanine Blue, Permanent Red, Chrome Yellow, and Phthalocyanine Green. The toner can further contain external additives, such as fine silica powder and titania, for improvement on fluidity and anti-agglomeration.

The method for preparing the toner is not particularly restricted. For example, a binder resin, a charge control agent and a colorant are dry blended thoroughly in a mixing machine, e.g., a Henschel mixer, and the blend is melt-kneaded in, e.g., a twin-screw extruder. After cooling, the mixture is ground, classified, and mixed with necessary additives in a mixing machine, etc.

The present invention will now be illustrated in greater detail with reference to Examples. Unless otherwise noted, all the percents are by weight.

EXAMPLE 1

A silicone resin (a product of Dow Corning Toray Silicone) was mixed with 15%, based on the solid content of the silicone resin, of conductive carbon (a product of Ketjenblack International Company) and 2%, based on the solid content of the silicone resin, of a quaternary ammonium salt (tetramethylammonium acetate) to prepare resin 1.

Manganese ferrite particles (core) having an average particle size of 60 $\mu$m was coated with 1.5% of resin 1 in a fluidized bed coating apparatus and baked at 250° C. for 2 hours to obtain carrier 1.

EXAMPLE 2

Resin 2 was prepared in the same manner as for resin 1 except for increasing the amount of the same quaternary ammonium salt (tetramethylammonium acetate) as used in EXAMPLE 1 to 5% based on the solid content of the silicone resin. Carrier 2 was obtained in the same manner as in Example 1 but by using resin 2.

EXAMPLE 3

Resin 3 was prepared in the same manner as for resin 1 except for decreasing the amount of the same quaternary ammonium salt (tetramethylammonium acetate) as used in EXAMPLE 1 to 0.2% based on the solid content of the silicone resin. Carrier 3 was obtained in the same manner as in Example 1 except for using resin 3.

EXAMPLE 4

The same silicone resin as used in EXAMPLE 1 was mixed with 10%, based on the solid content of the silicone resin, of a quaternary ammonium salt (tetraethylammonium acetate) to prepare resin 4. Carrier 4 was obtained in the same manner as in Example 1 except for using resin 4.

COMPARATIVE EXAMPLE 1

Manganese ferrite particles (core) having an average particle size of 60 $\mu$m was coated with 1.5% of the same silicone resin as used in EXAMPLE 1 in a fluidized bed coating apparatus and baked at 250° C. for 2 hours to obtain carrier 5.

COMPARATIVE EXAMPLE 2

Resin 6 was prepared in the same manner as in Example 1, except for replacing the quaternary ammonium salt with dibutyltin dilaurate. Carrier 6 was obtained in the same manner as in Example 1 except for using resin 6.

COMPARATIVE EXAMPLE 3

Resin 7 was prepared in the same manner as in Example 1, except for replacing the quaternary ammonium salt with tetrabutoxytitanium. Carrier 7 was obtained in the same manner as in Example 1 except for using resin 7.

Evaluation:

Each of the carriers 1 to 7 obtained in Examples 1 to 4 and Comparative Examples 1 to 3 was mixed with a polyester-based toner to prepare a two-component developer having a toner concentration of 5%. A copying test was carried out on a commercially available plain paper copier of reversal development system having a photoreceptor made of an organic photoconductor. The performance of the developers was evaluated as follows. The test results obtained are shown in Table 1 below.

1) Chargeability

The charge quantity was measured with a blow-off powder charge quantity meter manufactured by Toshiba Chemical Co., Ltd.

2) Resistivity

The resistivity was measured with SM-5E Super Megohm Meter manufactured by Toa Electronics Ltd.

3) Fluidity

The fluidity was measured in accordance with JIS-Z2502 "Test Method of Metal Powder Fluidity".

4) Image Density

The image density of a solid image area was measured with a Macbeth densitometer.

5) Fog

The fog on the white background was measured with a color difference meter Z-300 manufactured by Nippon Denshoku Kogyo K. K. or an equivalent instrument. 6) Overall Judgement Overall judgement on the performance of the developer was made in terms of change in image characteristics according to the following rating system.

A . . . Substantially no change was observed.

B . . . Some acceptable change was observed.

C . . . Unacceptable change was observed.

D . . . Considerable change was observed.

TABLE 1

| | | | | Initial | | | | | After Producing 200,000 Copies | | | | | |
|---|---|---|---|---|---|---|---|---|---|---|---|---|---|---|
| | | | | Carrier Physical Properties | | | Image Characteristics | | Carrier Physical Properties | | | Image Characteristics | | |
| | | | | Charge | | Fluidity | | | Charge | | Fluidity | | | Over-all |
| Example No. | Carrier (wt %) | Catalyst (wt %) | Carbon (wt %) | Quantity (μC/g) | Resistivity (Ω) | (sec/50 g) | Image Density | Fog | Quantity (μC/g) | Resistivity (Ω) | (sec/50 g) | Image Density | Fog | Judgement |
| Ex. 1 | 1 | 2.0 | 15.0 | 16.2 | 4.6E+06 | 27.6 | 1.42 | 0.33 | 15.1 | 5.2E+06 | 28.0 | 1.40 | 0.39 | A |
| Ex. 2 | 2 | 5.0 | 15.0 | 16.9 | 5.8E+06 | 28.7 | 1.40 | 0.29 | 16.5 | 6.3E+06 | 28.6 | 1.39 | 0.36 | A |
| Ex. 3 | 3 | 0.2 | 15.0 | 15.8 | 3.7E+06 | 28.4 | 1.38 | 0.39 | 13.9 | 7.2E+07 | 29.1 | 1.30 | 0.65 | B |
| Ex. 4 | 4 | 10.0 | — | 17.0 | 1.5E+10 | 27.5 | 1.28 | 0.67 | 15.9 | 2.0E+11 | 28.5 | 1.20 | 0.90 | B |
| Comp. Ex. 1 | 5 | — | — | 14.8 | 9.7E+09 | 29.1 | 1.25 | 0.87 | 22.3 | 1.1E+12 | 32.1 | 0.80 | 1.23 | D |
| Comp. Ex. 2 | 6 | 2.0 | 15.0 | 18.9 | 3.0E+06 | 27.2 | 1.37 | 0.31 | 25.9 | 5.1E+08 | 29.8 | 1.02 | 0.93 | C |
| Comp. Ex. 3 | 7 | 2.0 | 15.0 | 21.0 | 6.1E+06 | 26.6 | 1.35 | 0.29 | 35.2 | 8.2E+08 | 30.9 | 0.95 | 1.30 | D |

As is shown in Table 1 above, the developers of Examples 1 to 4 maintain satisfactory image quality over a long service life, showing no appreciable change in resistivity, chargeability, fluidity, image density and fog, as compared with those of Comparative Examples 1 to 3.

What is claimed is:

1. A carrier for an electrophotographic developer comprising a carrier core coated with a silicone resin containing a quaternary ammonium salt as a curing catalyst.

2. The carrier according to claim 1, wherein said silicone resin contains said quaternary ammonium salt in an amount of 0.5 to 5% by weight.

3. The carrier according to claim 1, wherein said silicone resin contains an electrically conducting agent.

4. An electrophotographic developer comprising a toner and a carrier, the carrier comprising a carrier core coated with a silicone resin containing a quaternary ammonium salt as a curing catalyst.

5. The electrophotographic developer according to claim 4, wherein said silicone resin contains said quaternary ammonium salt in an amount of 0.5 to 5% by weight.

6. The electrophotographic developer according to claim 4, wherein said silicone resin contains an electrically conducting agent.

7. The carrier according to claim 1, wherein said quaternary ammonium salt as a curing catalyst is represented by formula:

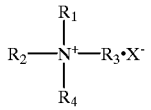

wherein $R_1$, $R_2$, $R_3$ and $R_4$ each represent a hydrogen atom, an alkyl group or a derivative thereof, or an allyl group or a derivative thereof, and X represents a sulfate ion, a nitrate ion, an organic sulfate ion, an organic nitrate ion or an organic carboxylate ion.

8. The carrier according to claim 7, wherein said X represents a nitrate ion, an organic nitrate ion or an organic carboxylate ion.

9. The electrophotographic developer according to claim 4, wherein said quaternary ammonium salt as a curing catalyst is represented by formula:

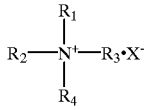

wherein $R_1$, $R_2$, $R_3$ and $R_4$ each represent a hydrogen atom, an alkyl group or a derivative thereof, or an allyl group or a derivative thereof, and X represents a sulfate ion, a nitrate ion, an organic sulfate ion, an organic nitrate ion or an organic carboxylate ion.

10. The electrophotographic developer according to claim 9, wherein X represents a nitrate ion, an organic nitrate ion or an organic carboxylate ion.

11. A carrier for an electrophotographic developer comprising a carrier core coated with a silicone resin containing from 0.2 to 10% by weight of a quaternary ammonium salt as a curing catalyst represented by the following formula:

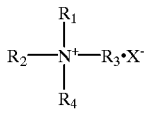

wherein $R_1$, $R_2$, $R_3$ and $R_4$ each represent a hydrogen atom, an alkyl group or a derivative thereof, or an allyl group or a derivative thereof, and X represents a sulfate ion, a nitrate ion, an organic sulfate ion, an organic nitrate ion or an organic carboxylate ion.

* * * * *